United States Patent [19]

Banks et al.

[11] 4,045,253

[45] Aug. 30, 1977

[54] PASSIVATING METAL SURFACES

[75] Inventors: William P. Banks; Larry D. Martin, both of Duncan, Okla.

[73] Assignee: Halliburton Company, Duncan, Okla.

[21] Appl. No.: 666,855

[22] Filed: Mar. 15, 1976

[51] Int. Cl.[2] ..... C23F 9/02

[52] U.S. Cl. ..... 148/6.14 R; 148/6.15 R; 134/27; 134/41; 252/394; 252/389 A; 21/2.7 R

[58] Field of Search ..... 134/27, 41; 252/394, 252/389 A; 148/6.14 R, 6.15 R; 21/2.7 R

[56] References Cited

U.S. PATENT DOCUMENTS

| | | | |
|---|---|---|---|
| 3,067,070 | 12/1962 | Loucks | 134/27 |
| 3,132,975 | 5/1964 | Freud | 148/6.14 R |
| 3,257,160 | 6/1966 | Zimmermann et al. | 21/2.7 R |
| 3,272,738 | 9/1966 | Pitzer et al. | 134/3 X |
| 3,415,692 | 12/1968 | Armentano | 148/6.14 R |
| 3,447,965 | 6/1969 | Teumac | 148/6.14 R |
| 3,460,989 | 8/1969 | Rusch | 148/6.15 R |
| 3,677,827 | 7/1972 | Weaver | 148/6.14 R |
| 3,783,035 | 1/1974 | Elsenlohr et al. | 148/6.14 R |
| 3,901,651 | 8/1975 | Benner | 21/2.7 R |

*Primary Examiner*—Ralph S. Kendall

*Attorney, Agent, or Firm*—Thomas R. Weaver; John H. Tregoning

[57] ABSTRACT

A method for passivating acid-cleaned ferrous metal surfaces is disclosed. The method features the use of an aqueous passivating solution having a pH of greater than about 8, comprising a base, an oxygen containing gas, and one of hydrazine, an iron complexing agent and mixtures thereof, wherein the method comprises contacting an acid-cleaned ferrous metal surface with the passivating solution at temperatures up to about 400° F or greater.

8 Claims, No Drawings

PASSIVATING METAL SURFACES

This invention relates to a method of treating ferrous metal surfaces. It further relates to a method of removing deposits, including metallic oxide-containing deposits, from ferrous metal surfaces. This invention more particularly relates to a method of passivating freshly cleaned ferrous metal surfaces, such as the internal surfaces of boilers, feed water heaters, heat exchangers and similar equipment.

In the operation of heat transfer equipment incrustations of contaminants in the form of scale usually are formed on the surfaces thereof. Scale formation is especially troublesome in heat transfer equipment having surfaces in contact with water and steam, for example, industrial water heating and steam generation equipment, despite the fact that in many instances the water employed in such equipment is relatively pure. The incrustations formed on the surfaces in contact with water and steam can include deposits of copper and iron oxide and certain inorganic salts. Since scale can substantially reduce the heat transfer characteristics of the equipment, it is conventional practice to periodically remove the incrusted scale from the surfaces by known chemical cleaning processes.

Numerous chemical cleaning techniques have been used to effect the removal of the scale incrustations. One common approach is to employ a treatment wherein an aqueous acid solution is utilized to dissolve and/or disintegrate the contaminant deposits. The acids utilized can include the mineral acids, for example, hydrochloric acid and phosphoric acid, and the organic acids, for example citric acid, ethylenediaminetetraacetic acid and the polyphosphonic acids.

In a typical process for the chemical cleaning of a steam generator utilizing an acid solution to remove scale deposits from the ferrous metal surfaces of the generator, an aqueous acid solution containing a corrosion inhibitor and, in some cases, a copper complexing agent, is introduced into the generator to thereby place the acid in contact with the scaled surfaces; the contact is maintained for a time and at a temperature sufficient to dissolve the scale. At the end of the desired treating time the spent acid solution is drained from the generator and an attempt is made to remove any acid remaining in the generator by at least one rinse step wherein the generator is filled with water which is subsequently drained therefrom. This rinse step helps to dilute any acid remaining to thereby at least partially diminish the effect of the acid by removing it from the equipment. The rinsing also helps to remove acid soluble-alkali insoluble material from the equipment.

When the spent acid and rinse water are drained from the equipment prior to passivation, it is ordinarily necessary to exclude the presence of air from the acid-cleaned surface to prevent the formation thereon of an iron oxide known as flash rust. This is accomplished in practice by draining the equipment under a nitrogen gas atmosphere.

After the rinse step, or steps, an alkaline solution is introduced into the equipment and the temperature of the alkaline solution in the boiler is adjusted to a value usually less than about 200° F. The alkaline solution, which ordinarily contains a chemical such as sodium nitrite, serves to neutralize any acid remaining in the boiler and to passivate the freshly acid-treated ferrous surface. It is known that passivating a ferrous surface renders the surface chemically inactive or at least less chemically active such that the surface resists the formation of rust. At the conclusion of this passivation step, the alkaline solution is drained from the equipment, the equipment is inspected and, thereafter, the steam generator is returned to normal steam service.

This invention improves the above described process. The specific improvement is in the passivation step and involves the use of an aqueous passivating solution not heretofore known and treatment temperatures not heretofore practiced. The passivating solution of this invention is an aqueous solution containing a base, an oxygen containing gas, and a material selected from the group consisting of hydrazine, an iron complexing agent and mixtures thereof.

Passivating solutions known in the prior art do not provide entirely satisfactory passivating results when the passivating treatment is conducted at temperatures greater than about 200° F. We have discovered that the alkaline solution above described which contains hydrazine and/or an iron complexing agent provides excellent passivating results at temperatures greater than about 220° F and up to temperatures wherein the chemicals utilized in the solution, specifically the organic chemicals, commence to degrade.

A passivating solution having high temperature operability is particularly useful in equipment, for example natural circulation boilers, wherein circulation of the solution in the equipment is caused by heating rather than by pumping. The passivating solution of this invention is therefore highly useful as a boil out solution, that is, as a passivating solution, for natural circulation boilers.

There are generally three types of steam generators, or boilers, utilized in industry: natural circulation boilers, controlled circulation boilers, and once-through (also called super critical) boilers. Liquids in controlled circulation boilers and once-through boilers can be circulated with ease while liquids in natural circulation boilers can not. Natural circulation boilers do not have internal circulation pumps which can distribute liquids, such as a passivating solution, throughout. Accordingly, the natural circulation boiler will not achieve sufficient circulation of solutions held therein until a suitable temperature is achieved in it. Such a suitable temperature is ordinarily that of steam at or in excess of about 100 pounds per square inch gauge. The temperature of saturated steam at 100 psig is about 340° F. Accordingly, to achieve adequate circulation of a passivating solution in a natural circulation boiler and hence to achieve adequate contact of the solution with the freshly acid-cleaned surfaces of the generator, it is desirable to heat the passivating solution to a temperature where natural circulation occurs.

A problem with heating prior passivating solutions to high temperatures, particularly those containing a nitrite, is that as the temperature of the passivating solution increases, the ability of the passivating solution to achieve satisfactory passivation of acid-cleaned ferrous surfaces decreases. Accordingly, the temperature of the solutions containing nitrite are generally held to temperatures of less than about 200° F.

We have discovered that passivating solutions containing water, a base, an oxygen containing gas, such as air, and a material selected from hydrazine and/or an iron complexing agent can be used very satisfactorily at temperatures in ranges considered desirable for passivating the surfaces of natural circulation boilers; that is, at temperatures in excess of 220° F. In addition, the aqueous passivating solution of this invention also operates very satisfactorily at temperatures less than 220° F, that is at temperatures ordinarily used in the passivation of acid-cleaned surfaces. Thus the passivating solution of this invention has wide applicability.

In another aspect of this invention, the use of nitrogen gas during the draining of spent acid and in the rinse steps, as previously described, can be eliminated providing that the complexing agent is present along with the base. Accordingly, such solutions can include a base, an oxygen containing gas, an iron complexing agent and, if desired, hydrazine. In fact, the use of an iron complexing agent in the passivating solution of our invention permits the complete elimination of the heretofore utilized rinsing step and the elimination of the necessity for draining of the spent acid solution in a nitrogen atmosphere.

In the passivation of acid-treated ferrous metal surfaces in accordance with this invention, the freshly acid-treated surface is contacted with the aqueous solution of this invention as described above and the contact is maintained for a time sufficient to neutralize and passivate the freshly acid-cleaned ferrous metal surface. The pH of the solution in contact with the acid-cleaned surface is preferably greater than about 8, and the contacting is preferably conducted at a temperature greater than about 220° F, but less than the degradation temperature of the chemicals utilized in the solution.

A preferred temperature range is from about 220° F to about 400° F; a more preferred range is from about 250° F to about 375° F; and the most preferred range for passivating acid-treated ferrous surfaces in accordance with our invention is in the range of about 300° F to about 350° F.

The preferred pH of the treating solution utilized herein is greater than 8. Preferably the pH of the solution has a value in the range of from about 9 to about 14. The most preferred pH range is from about 10 to about 14.

The passivating solution of our invention is maintained in contact with the acid-treated surface for a time sufficient to neutralize as well as to passivate the acid-cleaned surface. A sufficient time is generally in the range of from about 1 to about 12 hours. Satisfactory results can be achieved in times in the range of from about 2 to about 6 hours.

This invention provides a process for the simultaneous neutralization and passivation of acid-treated ferrous metal surfaces. Passivation has been discussed. The solution also has the ability to neutralize any acid remaining in the boiler subsequent to draining and rinsing. In some heat transfer equipment, such as for example in natural circulation boilers, spent acid can be trapped along the bottoms of the headers and drums and in sections of the boiler, otherwise referred to in the art as "dead legs." The passivating solution of this invention can dilute and neutralize spent acid trapped in such dead legs and at the same time passivate the acid-cleaned surface.

The base materials utilized herein include those ordinarily known as strong alkaline materials and the salts of strong bases and weak acids. Such materials include the alkali metal hydroxides, the alkali metal carbonates, the alkali metal borates, the alkali metal gluconates, certain organic bases, such as the ethanolamines and mixtures thereof. The quantity of base material utilized in the passivating solution of this invention is in the range of from about 0.01 to 3.0, preferably 0.05 to 2.0, and still more preferably in the range of from about 0.1 to about 1.0 percent base by weight of solution. Specific chemicals within the scope of base materials useful herein include sodium hydroxide, potassium hydroxide, sodium carbonate, potassium carbonate, triethanolamine, sodium borate and sodium gluconate. Of the above materials the preferred bases are sodium hydroxide, sodium carbonate and sodium gluconate. It was mentioned that mixtures of bases are quite useful. The preferred mixtures include the following: sodium hydroxide and sodium carbonate; carbonate and borates; sodium hydroxide and triethanolamine; and sodium hydroxide, sodium carbonate and sodium gluconate.

The passivating solution of this invention includes an oxygen containing gas. It has been observed that passivating solutions not including an oxygen containing gas do not achieve satisfactory passivation of an acid-cleaned ferrous metal surface. It is desirable that the quantity of oxygen containing gas utilized in the passivating solution be in an amount sufficient to saturate the solution with the gas at the temperature and pressure of the treatment. For example, at 25° C and atmospheric pressure the concentration of oxygen in water at saturation is 0.004 percent oxygen by weight of water. However, it is understood that greater concentrations of gas can be achieved at high pressures. Oxygen containing gases useful include oxygen itself as well as air. It has been observed that the absence of air from a passivating solution, regardless of the presence of other constituents, will not produce satisfactory passivating results.

The passivating solution of this invention, in one preferred embodiment, contains hydrazine. As seen in the example provided herein, when hydrazine is present with an inorganic base, an organic base or mixtures thereof, the passivating results are very satisfactory. The presence of hydrazine in the passivating solution of this invention enhances the formation of a tightly adherent oxide film on the treated surface which protects the treated surface and which persons skilled in the art recognize to be a very desirable result of a passivating treatment.

The passivating solution of this invention, containing a mixture of hydrazine and an iron complexing agent, provides not only satisfactory passivation at high temperatures, in accordance with this invention, but in addition such a solution provides the tightly adherent film referred to and also permits the elimination of the rinsing steps and the need for nitrogen blankets as described previously. The quantity of hydrazine useful herein is in the range of from about 0.001 to about 0.1, perferably 0.005 to 0.075, and still more preferably in the range of from about 0.025 to about 0.05 percent hydrazine by total weight of solution.

In another preferred embodiment the passivating solution of this invention contains an iron complexing agent. As seen in the examples provided herein, when an iron complexing agent is present with one of the base materials utilized herein, the passivating results are very satisfactory. It has been observed that certain base materials also function as iron complexing materials. It has been observed that these materials, for example, the organic base, triethanolamine, and sodium gluconate, a salt of a strong base and a weak acid, provide very satisfactory passivating results in the presence of hydrazine and/or with another iron complexing agent. In addition, a complexing agent can form alkali soluble complexes with the metal ions of the dissolved incrustants. The action of the complexing agent prevents the dissolved ions in the acid solution, which can remain in the system after draining, from precipitating as a sludge during the neutralizing operation. As a consequence, the alkaline solution can be added after the bulk of the inhibiting acid is removed without the time consuming intermediate rinsing steps heretofore utilized.

The iron complexing agents useful herein include the polyphosphonic acids having the formulas:

(1)

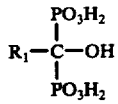

where $R_1$ is selected from the class consisting of $C_1$ to $C_{12}$ alkyl groups and the group

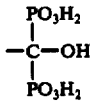

and (2)

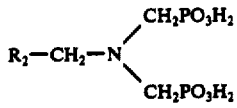

where $R_2$ is selected from the class consisting of —H,—$PO_3H_2$, $C_1$ to $C_{12}$ alkyl groups, and the group

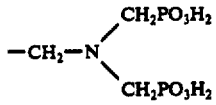

and the alkali metal and amine salts thereof; the alkali metal gluconates; the alkali metal salts of ethylenediaminetetraacetic acid; the ethanolamines and mixtures thereof.

Of the polyphosphonic acids, those preferred herein are the acids within the scope of formula (1) above. Specific examples of iron complexing agents useful herein include 1-hydroxyethilidine-1,11 -diphosphonic acid, the sodium salt of ethylenediaminetetraacetic acid, sodium gluconate and mixtures thereof.

The quantity of iron complexing agent useful herein is in the range of from about 0.01 to 1.0, preferably 0.05 to 0.5, and still more preferably in the range of from about 0.1 to 0.3 percent complexing agent by weight of solution.

In preparing the passivating solutions useful in this invention, the order of mixing of the chemicals with the water to form the solution is of no known critical importance; however, the presence of dissolved oxygen in the passivating solution is of critical import; accordingly, any method of mixing which permits the dissolving of oxygen from, for example, the air, in the passivating solution is encouraged.

In preparing the passivating solution, it is preferred that the base material be added to the water to form a base solution; thereafter, add the hydrazine to the base solution of the complexing agent to the base solution. Where the passivating solution contains both hydrazine and a complexing agent, it is desired, but not required, that the complexor be added to the base solution prior to the addition thereto of the hydrazine. In an alternative method, the base and the hydrazine can be added simultaneously to the water; however, the hydrazine should not be mixed directly with an inorganic base. Hydrazine can be directly mixed with an organic base, such as for example, triethanolamine.

Sufficient oxygen can be dissolved in the passivating solution when the solution is circulated through a centrifugal pump during normal chemical mixing.

In the examples which follow, solutions are tested to determine there ability to passivate freshly acid-cleaned steel. The procedure utilized in the cleaning and passivating of the steel is set out below:

EXPERIMENTAL PROCEDURE

1. Remove mill scale, corrosion products and other deposits from all surfaces of a 1 × 2 × ⅛ inch mild steel coupon by striking the surfaces of the coupon with a high velocity stream of grade 625F glass beads and thereafter soaking the bead-blasted mild steel coupon for 10 minutes in a bath containing 5% hydrochloric acid solution which is maintained at a temperature of 75° F.
2. Remove the acid-cleaned coupon from the acid bath and permit the acid to drain from the coupon under room atmosphere for 5 minutes.
3. Rinse the coupon with approximately 400 milliliters of deionized water.
4. Repeat step 3 using an additional 400 milliliters of deionized water.
5. Permit the rinse water to drain from the coupon under room atmosphere for about 5 minutes.
6. Place the acid-cleaned coupon in a glass container. One edge of the coupon rests on the bottom of the container and one edge of the coupon leans against the side of the container. Introduce a quantity (about 80 milliliters) of the passivating solution into the glass container sufficient to immerse and fully cover the coupon with the solution. Place a cover on the glass container which does not seal the container. Place the covered container which holds the coupon and test solution into a second container which is capable of withstanding high internal pressure. Introduce a sufficient additional quantity (about 25 milliliters) of the passivating solution utilized in the glass container into the annulus space between the first container and the second container such that the additional solution surrounds the exterior of the glass container, but does not enter the covered glass container. Seal the second container and apply heat thereto until the temperature on the interior thereof is about 350° F. The 350° F temperature is then maintained for a period of 6 hours.
7. At the end of the 6 hour time period, place the second container into a water bath which is maintained at a temperature of approximately 75° F. When the interior temperature of the second container is approximately 200° F, unseal the second container and remove the coupon from the first container. Permit the passivating solution to drain from the coupon under room atmosphere for 5 minutes.
8. Place the coupon into an air chamber in which the air is approximately saturated with water vapor and which is maintained at a temperature of 150° F. Permit the coupon to remain in the high humidity chamber for 4 days. Remove the coupon and observe the extent of rusting of the coupon surfaces.

The passivating solutions utilized in the tests all consist of chemicals dissolved in water. The specific chemicals utilized in each test are those identified in the tables which follow having numbers in a column headed by a chemical. The numbers indicate percent chemical by total weight of solution. For example, in Table 1, Run No. 1, the solution utilized consists of 1 percent sodium hydroxide by weight of solution and 0.05 percent hydrazine by weight of solution. The remainder of the solution is water.

Because no attempt is made to exclude the presence of air from the test solutions or from the atmosphere within the first and second containers, the solutions contain air under the test pressures and temperatures. Accordingly, the columns in the tables headed by the word "Air" indicate the presence of air in each solution tested.

For purposes of comparison, a mild steel coupon is prepared, as set out above in Steps 1, 2, 3, 4, 5 and 8. The extent of rusting of the thus treated coupon is observed to be heavy, which carries the numerical value of 8 as is further explained below.

In the tables which follow, the observed degrees of rusting are identified by number according to the following schedule:

0 = None
1 = None to Trace
2 = Trace
3 = Trace to Light
4 = Light
5 = Light to Moderate
6 = Moderate
7 = Moderate to Heavy
8 = Heavy
9 = Heavy to Very Heavy
10 = Very Heavy The results are reported in Tables 1, 1A, 1B, 1C and 1D below. Table 1 below contains Runs 1 through 27. Tables 1A, 1B, 1C and 1D do not contain additional data. The data in Tables 1A, 1B, 1C and 1D merely repeat some of the results shown in Table 1 for purposes of observation and discussion.

TABLE 1

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent of Rusting |
|---|---|---|---|---|---|---|---|---|---|---|---|
| 1 | 1.0 | | | | | | | 0.05 | X | | 1 |
| 2 | | 1.0 | | | | | | 0.05 | X | | 2 |
| 3 | 0.5 | 0.5 | | | | | | 0.05 | X | | 2 |
| 4 | | | | 0.3 | | | | 0.05 | X | | 2 |
| 5 | | | | 0.1 | | | | 0.05 | X | | 2 |
| 6 | 0.5 | 0.5 | | | | 0.25 | 0.25 | | X | | 2 |
| 7 | | | | | 0.25 | | 0.25 | 0.05 | X | | 2 |
| 8 | 0.1 | 0.5 | | | 0.1 | | | | X | | 3 |
| 9 | | 0.5 | | 0.3 | | | | 0.05 | X | | 4 |
| 10 | 0.5 | | | 0.3 | | | | 0.05 | X | | 4 |
| 11 | 1.0 | | | | 0.25 | | | 0.05 | X | | 4 |
| 12 | | | 1.0 | | | | | 0.05 | X | | 4 |
| 13 | | 0.5 | 0.5 | | | | | 0.05 | X | | 4 |
| 14 | | | 0.5 | 0.3 | | | | 0.05 | X | | 4 |
| 15 | | | | | | 0.25 | 0.25 | 0.05 | X | | 4 |
| 16 | | 1.0 | | | | | | | X | | 4 |
| 17 | 0.5 | 0.5 | | | 0.25 | | 0.25 | | X | | 4 |
| 18 | 1.0 | | | | 0.25 | | | | X | | 4 |
| 19 | | | | 0.1 | | | | | X | | 5 |
| 20 | | | | | | 0.25 | 0.25 | | X | 0.5 | 5 |
| 21 | | | | | 0.25 | | 0.25 | | X | 0.5 | 5 |
| 22 | | 1.0 | | | | | | | X | 0.5 | 5 |
| 23 | 0.5 | 1.0 | | | | | | | X | 0.5 | 5 |
| 24 | 0.5 | | | | | | | | X | 0.5 | 6 |
| 25 | | | 1.0 | | | | | | X | 0.5 | 6 |
| 26 | 1.0 | | | | 0.25 | | | | X | 0.5 | 6 |
| 27 | | | | 0.1 | | | | | X | 0.5 | 6 |

*Triethanolamine
**1-hydroxyethylidine-1,1-diphosphonic acid
***Tetrasodium salt of ethylenediaminetetraacetic acid
****Sodium salt of gluconic acid Table 1 clearly shows the contribution of hydrazine in obtaining good passivating results and the improvement of this invention over those passivating solutions containing nitrite. Runs 1 through 15 and 17 and 18 demonstrate the use of solutions within the scope of this invention. Runs 16 through 19 through 27 demonstrate passivating solutions utilized in the prior art when run under elevated temperatures. Table 1 shows that the use of a passivating solution containing a base, plus hydrazine, in the presence of dissolved air with or without the presence of a complexing agent is effective in the simultaneous passivation and neutralization of mild steel at elevated temperatures.

Table 1 also shows that a passivating solution containing a base and a complexing agent in the presence of dissolved air is effective in simultaneously neutralizing and passivating mild steel at elevated temperatures.

Table 1 shows that a passivating solution containing a base and a nitrite is not effective in passivating mild steel at elevated temperatures.

Comparing Runs No. 1, 2, 3, 4 and 5 clearly indicates the equivalency of the inorganic base, sodium hydroxide, the salt, sodium carbonate, and the organic base, triethanolamine, when combined with hydrazine and air for the purpose of passivating acid-cleaned steel. Such equivalency is unexpected and surprising.

TABLE 1A

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent of Rusting |
|---|---|---|---|---|---|---|---|---|---|---|---|
| 1 | 1.0 | | | | | | | 0.05 | X | | 1 |
| 3 | 0.5 | 0.5 | | | | | | 0.05 | X | | 2 |
| 6 | 0.5 | 0.5 | | | | 0.25 | 0.25 | | X | | 2 |

TABLE 1A-continued

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent of Rusting |
|---|---|---|---|---|---|---|---|---|---|---|---|
| 8 | 0.1 | 0.5 | | | 0.1 | | | | X | | 3 |
| 10 | 0.5 | | | 0.3 | | | | 0.5 | X | | 4 |
| 11 | 1.0 | | | | 0.25 | | | 0.05 | X | | 4 |
| 17 | 0.5 | 0.5 | | | 0.25 | | 0.25 | | X | | 4 |
| 18 | 1.0 | | | | 0.25 | | | | X | | 4 |
| 23 | 0.5 | 1.0 | | | | | | | X | 0.5 | 5 |
| 24 | 0.5 | | | | | | | | X | 0.5 | 6 |
| 26 | 1.0 | | | | 0.25 | | | | X | 0.5 | 6 |

*Triethanolamine
**1-hydroxyethylidine -1,1-diphosphonic acid
***Tetrasodium salt of ethylenediaminetetraacetic acid
****Sodium salt of gluconic acid Table 1A includes all runs in Table 1 involving the use of sodium hydroxide. It is seen that a combination of an inorganic base, such as sodium hydroxide and hydrazine, and various mixtures of sodium hydroxide with sodium carbonate, hydrazine and complexing agents, all provide excellent passivation as observed in the column headed "Extent of Rusting."

The combination of an inorganic base, such as sodium hydroxide and triethanolamine, as seen for example in Run No. 10, also provides excellent passivation results. While the combination of sodium hydroxide with triethanolamine appears to increase the extent of rusting, the advantage of such a mixture, as seen for example in Run 10, in actual practice permits the elimination of draining under nitrogen and the rinsing steps as described earlier in this disclosure.

Runs 6 and 8 not only indicate the value of complexing agents in obtaining good passivating results, but also permit the elimination of a nitrogen atmosphere and the rinsing steps as earlier indicated.

Runs No.23, 24 and 26 represent the use of solutions not within the scope of the invention. These runs merely indicate the detrimental effects of nitrite.

combination of air and sodium nitrite, air by itself, and a combination of hydrazine and air wherein the passivating solutions contain sodium carbonate and/or sodium borate alone and in combination with sodium hydroxide, and one of the passivators, hydrazine-air, air, or sodium nitrite-air. Notice Runs No. 2, 16 and 22 which provide direct comparison of the effects of air-nitrite, air by itself, and air-hydrazine in the presence of an equal quantity of sodium carbonate. The carbonate-hydrazine-air combination provides superior results to the carbonate-air combination, which provides superior results to the carbonate-nitrite combination. Similar comparisons can be made by observing Runs 3 and 23 and Runs 12 and 25. In all cases, the hydrazine-air-base combination provides superior results to the air-nitrite-base combination. At passivating temperatures less than the 350° F temperature utilized herein, the air-nitrite-base combination provides extent of rusting results superior to those recorded in Runs No. 22, 23 and 25, thus showing the undesirable effects that high temperature has on sodium nitrite-containing passivating solutions.

Runs 6, 8 and 17 show results obtained with solutions within the scope of the invention which utilize com-

TABLE 1B

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent Of Rusting |
|---|---|---|---|---|---|---|---|---|---|---|---|
| 2 | | 1.0 | | | | | | 0.05 | X | | 2 |
| 3 | 0.5 | 0.5 | | | | | | 0.05 | X | | 2 |
| 6 | 0.5 | 0.5 | | | | 0.25 | 0.25 | | X | | 2 |
| 8 | 0.1 | 0.5 | | | 0.1 | | | | X | | 3 |
| 9 | | 0.5 | | 0.3 | | | | 0.05 | X | | 4 |
| 12 | | | 1.0 | | | | | 0.05 | X | | 4 |
| 13 | | 0.5 | 0.5 | | | | | 0.05 | X | | 4 |
| 14 | | | 0.5 | 0.3 | | | | 0.05 | X | | 4 |
| 16 | | 1.0 | | | | | | | X | | 4 |
| 17 | 0.5 | 0.5 | | | 0.25 | | 0.25 | | X | | 4 |
| 22 | | 1.0 | | | | | | | X | 0.5 | 5 |
| 23 | 0.5 | 1.0 | | | | | | | X | 0.5 | 5 |
| 25 | | | 1.0 | | | | | | X | 0.5 | 6 |

*Triethanolamine
**1-hydroxyethylidine-1,1-diphosphonic acid
***Tetrasodium salt of ethylenediaminetetraacetic acid
****Sodium salt of gluconic acid Table 1B includes all the runs in Table 1 involving sodium carbonate and sodium borate. Table 1B enables in part the observation of the passivating effects of a plexing agents in lieu of hydrazine to obtain satisfactory passivating results.

TABLE 1C

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent Of Rusting |
|---|---|---|---|---|---|---|---|---|---|---|---|
| 4 | | | | 0.3 | | | | 0.05 | X | | 2 |
| 5 | | | | 0.1 | | | | 0.05 | X | | 2 |
| 9 | | 0.5 | | 0.3 | | | | 0.05 | X | | 4 |
| 10 | 0.5 | | | 0.3 | | | | 0.05 | X | | 4 |
| 14 | | | 0.5 | 0.3 | | | | 0.05 | X | | 4 |
| 19 | | | | 0.1 | | | | | X | | 5 |

TABLE 1C-continued

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent Of Rusting |
|---|---|---|---|---|---|---|---|---|---|---|---|
| 27 | | | | 0.1 | | | | | X | 0.5 | 6 |

*Triethanolamine
**1-hydroxyethylidine-1,1-diphosphonic acid
***Tetrasodium salt of ethylenediaminetetraacetic acid
****Sodium salt of gluconic acid Table 1C includes all the runs in Table 1 involving triethanolamine. Table 1C clearly shows the effects of a combination of triethanolamine and hydrazine, both alone and in combination with one of sodium hydroxide, sodium carbonate, and sodium borate to obtain satisfactory passivating results. Particular notice is made of Runs 5, 19 and 27 showing the effect of air-nitrite, air alone, and hydrazine-air in combination with triethanolamine to obtain passivating. As has been previously noted, nitrite does not foster satisfactory passivation at elevated temperatures whereas the combination of hydrazine and air does provide good passivating results.

TABLE 1D

| RUN NO. | NaOH | $Na_2CO_3$ | $Na_2B_4O_7$ | TEA* | Chemical A** | $Na_4$*** EDTA | Na**** Gluconate | $N_2H_4$ | Air | $NaNO_2$ | Extent of Rusting |
|---|---|---|---|---|---|---|---|---|---|---|---|
| 6 | 0.5 | 0.5 | | | | 0.25 | 0.25 | | X | | 2 |
| 7 | | | | | 0.25 | | 0.25 | 0.05 | X | | 2 |
| 8 | 0.1 | 0.5 | | | 0.1 | | | | X | | 3 |
| 11 | 1.0 | | | | 0.25 | | | 0.05 | X | | 4 |
| 15 | | | | | | 0.25 | 0.25 | 0.05 | X | | 4 |
| 17 | 0.5 | 0.5 | | | 0.25 | | 0.25 | | X | | 4 |
| 18 | 1.0 | | | | 0.25 | | | | X | | 4 |
| 20 | | | | | | 0.25 | 0.25 | | X | 0.5 | 5 |
| 21 | | | | | 0.25 | | 0.25 | | X | 0.5 | 5 |
| 26 | 1.0 | | | | 0.25 | | | | X | 0.5 | 6 |

*Triethanolamine
**1-hydroxyethylidine-1,1-diphosphonic acid
***Tetrasodium salt of ethylenediaminetetraacetic acid
****Sodium salt of gluconic acid Table 1D includes all runs in Table 1 involving the use of 1-hydroxyethylidine-1,1-diphosphonic acid, the sodium salt of ethylenediaminetetraacetic acid, and the sodium salt of gluconic acid.

The results in Table 1D show clearly the previously established trend that the presence of nitrite at elevated temperature does not provide satisfactory passivating results. However, the presence of hydrazine with a complexing agent may not always supply the superior results as would be suggested by the previous tables herein. Compare, for example, Runs 7, 17 and 21 with Runs 6, 15 and 20.

Run No. 8 in Table 1D provides a passivating solution consisting of sodium hydroxide, sodium carbonate and 1-hydroxyethylidine-1,1-diphosphonic acid, with respect to the ability of such solution to passivate. The results, as seen for Run No. 8, are very good. The solution utilized in Run No. 8 (as well as those in Runs 6, 7, 11, 15, 17 and 18) would thus not only provide the neutralizing capabilities to be expected from the alkaline portion of the solution, but also provides the ability to eliminate the need for rinsing and nitrogen as described previously.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

Having thus described the invention, that which is claimed is:

1. A method for the simultaneous neutralization and passivation of an acid-treated ferrous metal surface comprising:

contacting an acid-treated ferrous metal surface with an aqueous solution consisting essentially of a. a base selected from alkali metal hydroxides, ethanolamines, alkali metal carbonates, alkali metal gluconates, alkali metal borates and mixtures thereof, said base being present in said aqueous solution in the range of from about 0.01 to about 3.0 percent base by weight of said solution;

b. an oxygen containing gas present in said solution in an amount sufficient to saturate said solution with oxygen at the temperature and pressure of said contacting;

c. hydrazine present in said solution in the range of from about 0.001 to about 0.1 percent hydrazine by weight of said solution; and d. an iron complexing agent selected from the group consisting of alkali metal gluconates; alkali metal salts of ethylenediaminetetraacetic acid; ethanolamines; polyphosphonic acids having the formula

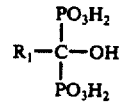

(1)

wherein $R_1$ is selected from the class consisting of $C_1$ to $C_{12}$ alkyl groups and the group

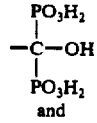

and (2)

-continued

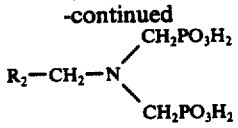

where $R_2$ is selected from the class consisting of —H,—$PO_3H_2$, $C_1$ to $C_{12}$ alkyl groups, and the group

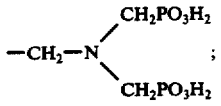

the alkali metal and amine salts of said polyphosphonic acids; and mixtures thereof; said complexing agent being present in said aqueous solution in the range of from about 0.01 to about 1.0 percent complexing agent by weight of said solution;

maintaining said contact for a time sufficient to neutralize and passivate said ferrous metal surface, wherein the pH of said solution is greater than about 8.0 and said contacting is conducted at a temperature greater than about 220° F and less than the degradation temperature of chemicals in said solution.

2. The method of claim 1 wherein said base is selected from the group consisting of sodium hydroxide, potassium hydroxide, sodium carbonate, potassium carbonate, triethanolamine, sodium gluconate, sodium borate and mixtures thereof and said iron complexing agent is selected from the group consisting of triethanolamine, sodium gluconate, 1-hydroxyethylidine-1,1-diphosphonic acid, the sodium salt of ethylenediaminetetraacetic acid and mixtures thereof.

3. The method of claim 2 wherein said complexing agent is 1-hydroxyethylidine-1,1-diphosphonic acid, and said base is a mixture of sodium hydroxide and sodium carbonate.

4. The method of claim 3 wherein said contact is maintained for a period of time in the range of from about 1 to about 12 hours.

5. The method of claim 4 wherein said pH has a value in the range of from about 9 to about 14.

6. The method of claim 5 wherein said ferrous metal surface is the interior surface of a boiler.

7. The method of claim 6 wherein said oxygen containing gas is air.

8. A method for the simultaneous neutralization and passivation of acid-treated ferrous metal surfaces, comprising:

contacting an acid-treated ferrous metal surface with an aqueous solution containing a base, an oxygen containing gas and an iron complexing agent;

maintaining said contact for a time sufficient to neutralize and passivate said ferrous metal surface, wherein the pH of said solution is greater than about 8.0 and said contacting is conducted at a temperature greater than about 220° F and less than the degradation temperature of chemicals in said solution;

wherein said base is a mixture of sodium hydroxide and sodium carbonate, said iron complexing agent is 1-hydroxyethylidine-1,1-diphosphonic acid, and said base is present in said solution in the range of from about 0.01 to about 1.0 percent complexing agent by weight of said solution; and wherein said oxygen containing gas is present in said solution in an amount sufficient to saturate said solution with oxygen at the temperature and pressure of said contacting.

* * * * *